US005975971A

United States Patent [19]

Kitajima

[11] Patent Number: 5,975,971

[45] Date of Patent: Nov. 2, 1999

[54] ENGINE SEAL AND CRANKCASE VENTILLATION ARRANGEMENT FOR OUTBOARD MOTOR

[75] Inventor: Kazuyuki Kitajima, Hamamatsu, Japan

[73] Assignee: Sanshin Kogyo Kabushiki Kaisha, Hamamatsu, Japan

[21] Appl. No.: 09/085,996

[22] Filed: May 27, 1998

[30] Foreign Application Priority Data

May 30, 1997 [JP] Japan ..... 9-141704

[51] Int. Cl.[6] ..... B63H 21/10

[52] U.S. Cl. ..... 440/88; 123/41.86

[58] Field of Search ..... 440/85, 88; 123/41.86

[56] References Cited

U.S. PATENT DOCUMENTS 3,550,567 12/1970 Crow ..... 123/41.86

4,969,422 11/1990 Ishikawa et al. ..... 123/41.86

5,078,101 1/1992 Anderson et al. ..... 440/85

5,514,015 5/1996 Okazawa et al. ..... 440/88

*Primary Examiner*—Stephen Avila

*Attorney, Agent, or Firm*—Knobbe, Martens, Olson & Bear LLP

[57] ABSTRACT

A crankcase seal and ventilation arrangement for an outboard motor that permits ventilating air to flow from the crankcase chamber into an induction system of the engine for air purification. In addition, the arrangement is such that oil, which may flow into the ventilating air chamber when the outboard motor is tilted up, can return to the crankcase chamber when the outboard motor is returned to its normal running condition.

16 Claims, 5 Drawing Sheets

ENGINE SEAL AND CRANKCASE VENTILLATION ARRANGEMENT FOR OUTBOARD MOTOR

BACKGROUND OF THE INVENTION

This invention relates to an outboard motor and more particularly to an improved engine seal and crankcase ventilation arrangement for an outboard motor.

As is well known, internal combustion engines are typically employed as the prime mover for outboard motors. The internal combustion engine positioning in an outboard motor is different from that normally employed in engine applications. Generally, internal combustion engines are mounted so that the crankcase shaft rotates about a horizontally disposed axis.

With an outboard motor, however, the engine is generally mounted so that the crankshaft rotates about a vertically extending axis. This is done so as to facilitate the connection of the crankshaft to the driveshaft which depends into the driveshaft housing and terminates at the lower end thereof where it drives a propulsion device for propelling a watercraft associated with the outboard motor.

The vertical positioning of the crankshaft gives rise to some unique design problems. With two-cycle engines, these problems are somewhat less because lubricant is not normally contained within the crankcase chamber. With a four-cycle engine, on the other hand, lubricant may be contained in the crankcase chamber but this lubricant is stored in a location which is generally removed from the crankcase chamber.

With an outboard motor, however, the outboard motor is frequently tilted up to an out-of-the-water condition even when attached to the watercraft. Furthermore, if the outboard motor is small it may oftentimes be carried in a horizontal position.

In either of the aforenoted conditions, lubricant can flow back into the crankcase chamber. Thus, the upper seal around the uppermost main bearing, considering the situation when the engine is supported vertically, may have to provide assurance that the lubricant cannot flow out of the crankcase chamber in the area around the upper main bearing when the engine crankshaft is horizontal.

Although it is possible to provide seals that prevent such flow, that area may also be utilized for ventilation of the crankcase and blow-by gases from the crankcase chamber. That is, it is desirable to ventilate the crankcase chamber so that the blow-by gases do not build up pressure in it. This can be conveniently done by removing the crankcase gases through the upper wall of the crankcase chamber. However, if there is an open passage, then the loss of lubricant through the path when the engine crankshaft is positioned horizontally can occur.

It is, therefore, a principal object of this invention to provide an improved crankcase seal and crankcase ventilating arrangement that is particularly adaptable for use in outboard motors.

It is a further object of this invention to provide a crankcase seal and ventilating arrangement for an internal combustion engine that provides a ventilating area at one end of the crankshaft and which will permit ventilating gases to flow freely out of the crankcase chamber but will preclude lubricant from flowing through the same path when the engine is positioned horizontally.

SUMMARY OF THE INVENTION

This invention is adapted to be embodied in a crankcase seal arrangement for an internal combustion engine having a crankcase chamber in which a crankshaft rotates. The crankcase chamber is defined at one end by a wall member through which one end of the crankshaft extends. A bearing is fixed in this wall member and journals the crankshaft end. The wall member defines at least in part, an air chamber formed contiguous to the bearing. An opening in the wall member provides communication between the crankcase chamber and the air chamber. A check valve controls the flow through the opening.

DETAILED DESCRIPTION OF THE PREFERRED EMBODIMENT

Figure 1:
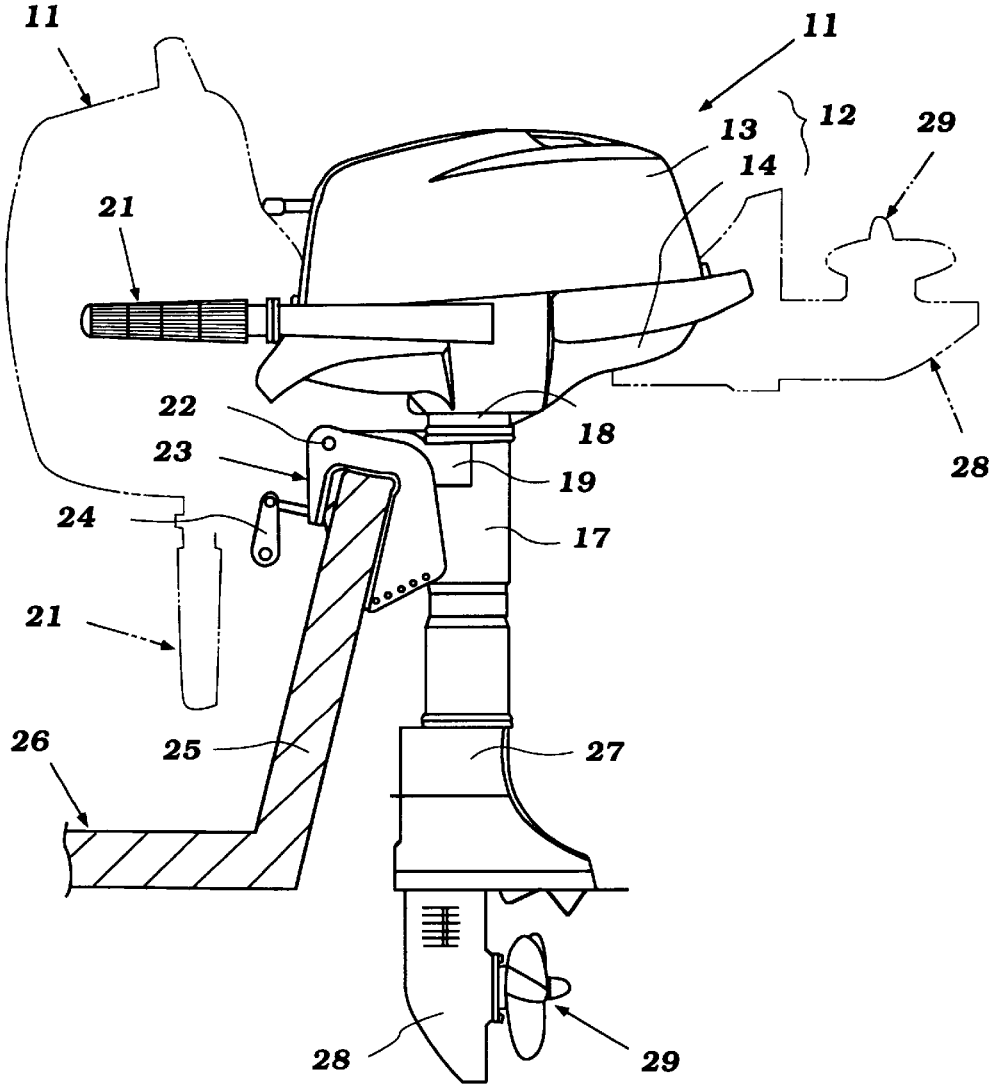
FIG. 1 is a side elevational view of an outboard motor constructed in accordance with an embodiment of the invention, as attached to the transom of a watercraft, which is shown partially and in cross-section. The outboard motor is shown in its normal driving position in solid lines and in a tilted up out of the water condition in phantom lines.

Referring now in detail to the drawings and initially to FIG. 1, an outboard motor constructed in accordance with an embodiment of the invention is identified generally by the reference numeral 11. The outboard motor 11 is comprised of a protective cowling, indicated generally by the reference numeral 12, The protective cowling is comprised of a main cowling member 13, which may be formed from a relatively lightweight rigid material such as a molded fiberglass reinforced resin or the like, and a lower tray portion 14, formed from a slightly heavier but still lightweight material such as an aluminum alloy or the like. The main cowling member 13 is detachably connected to the tray 14. An internal combustion engine, which does not appear in FIG. 1 but which is shown in the remaining figures and which is indicated generally by the reference numeral 15, is contained within the protective cowling 12.

As will become apparent from the description, the engine 15 is supported so that its crankshaft 16 rotates about a vertically extending axis. This is done so as to facilitate the driving of a driveshaft (not shown) that is contained and journaled within a driveshaft housing 17 that depends from the powerhead. This driveshaft housing is supported for rotational movement within a collar 18 of a bracket assembly 19 for steering about a vertically disposed axis. A tiller 21 is affixed to the tray portion 14 for this steering motion.

The swivel member 19 is pivotally connected by means of a pivot pin 22 to a clamping bracket, indicated generally by the reference numeral 23. The clamping bracket 23 carries a clamping device 24 for affecting detachable connection to a transom 25 of the hull of an associated watercraft, indicated generally by the reference numeral 26.

Tilting movement of the outboard motor about the pivot pin 24 from a normal drive position, shown in the solid lines, to a tilted up out-of-the-water position, shown in phantom lines in FIG. 1, permits trailering of the watercraft and/or permits the outboard motor 11 to be stored out of the water while still attached to the hull 25.

A lower unit comprised of an upper housing member 27 and a lower housing member 28 depends from the driveshaft housing 17. A transmission of a known type is contained within this lower unit housing member 28 and is driven by the aforenoted driveshaft. This transmission may include a forward neutral transmission although with a type of outboard motor illustrated, reverse drive may be accomplished by rotating the tiller 21 to a rearwardly facing position. In either event, this transmission drives a propeller 29 for propelling the watercraft 26 in a known manner.

The aforedescribed construction of the outboard motor 11 per se is primarily to permit those skilled in the art to understand the environment in which the invention is utilized. The actual physical structure of the outboard motor may be of any type known in this art and may include those in which the steering is accomplished by connecting the driveshaft housing 17 to a swivel bracket through a steering shaft.

Referring now to the remaining figures and initially primarily to FIG. 2, the engine 15 will be described in more detail. The engine 15 is, in the illustrated embodiment, of the inline type and includes a cylinder block 31 which forms one or more aligned cylinder bores 32, as seen in the remaining figures. In the illustrated embodiment, the engine 15 operates on a four-cycle principle. Although the invention is described in conjunction with a four-cycle inline type engine, the number of cylinders and cylinder placement may be of any desirable type. However, the invention has particular utility in conjunction with typical outboard motor applications where the cylinder bores 32 extend generally horizontally regardless of their layout.

A cylinder head 33 is affixed to the cylinder block 31 in a suitable manner and closes one end of the cylinder bore 32. A valve mechanism is mounted in the cylinder head assembly 33 and is operated by a suitable operating mechanism contained within a cam cover 34. Since the invention deals, as should be apparent from the foregoing comments, primarily with the crankshaft, crankcase ventilation and crankshaft seal assembly, those portions of the engine which may be considered to be conventional have been illustrated only partially or not at all. It will be readily apparent to those skilled in the art how the invention can be practiced with any type of engine structure.

An induction system, that includes an intake silencer device 35 draws atmospheric air from within the protective cowling and delivers it to the engine cylinders is provided. This induction silencer device 35 supplies the intake air and, if desired, fuel through a suitable charge-forming device to the engine cylinders through a charge former 36 and intake manifold 37.

Figure 3:
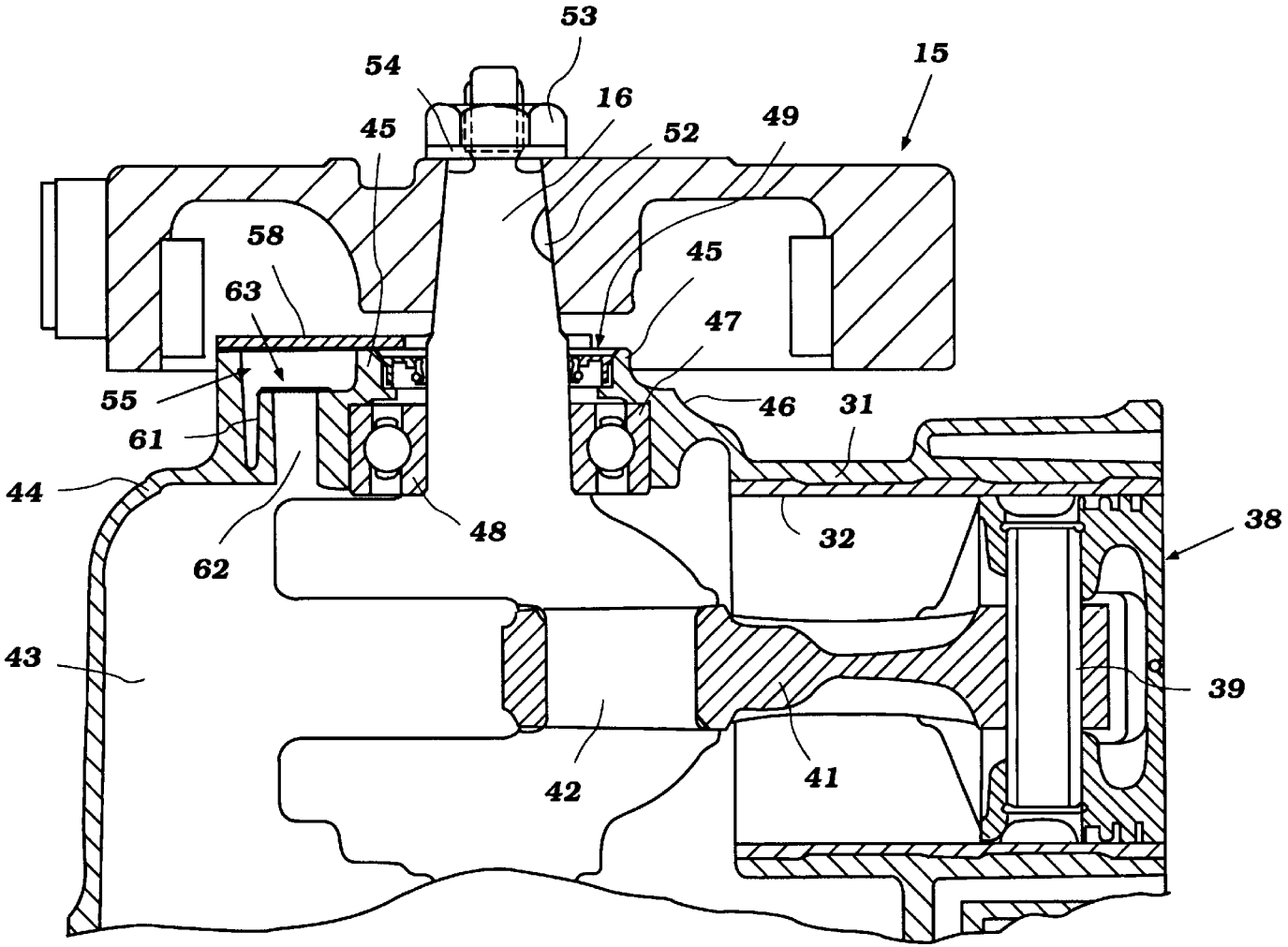
FIG. 3 is a further enlarged cross-sectional view taken along the line 3—3 of FIG. 2.
Figure 4:
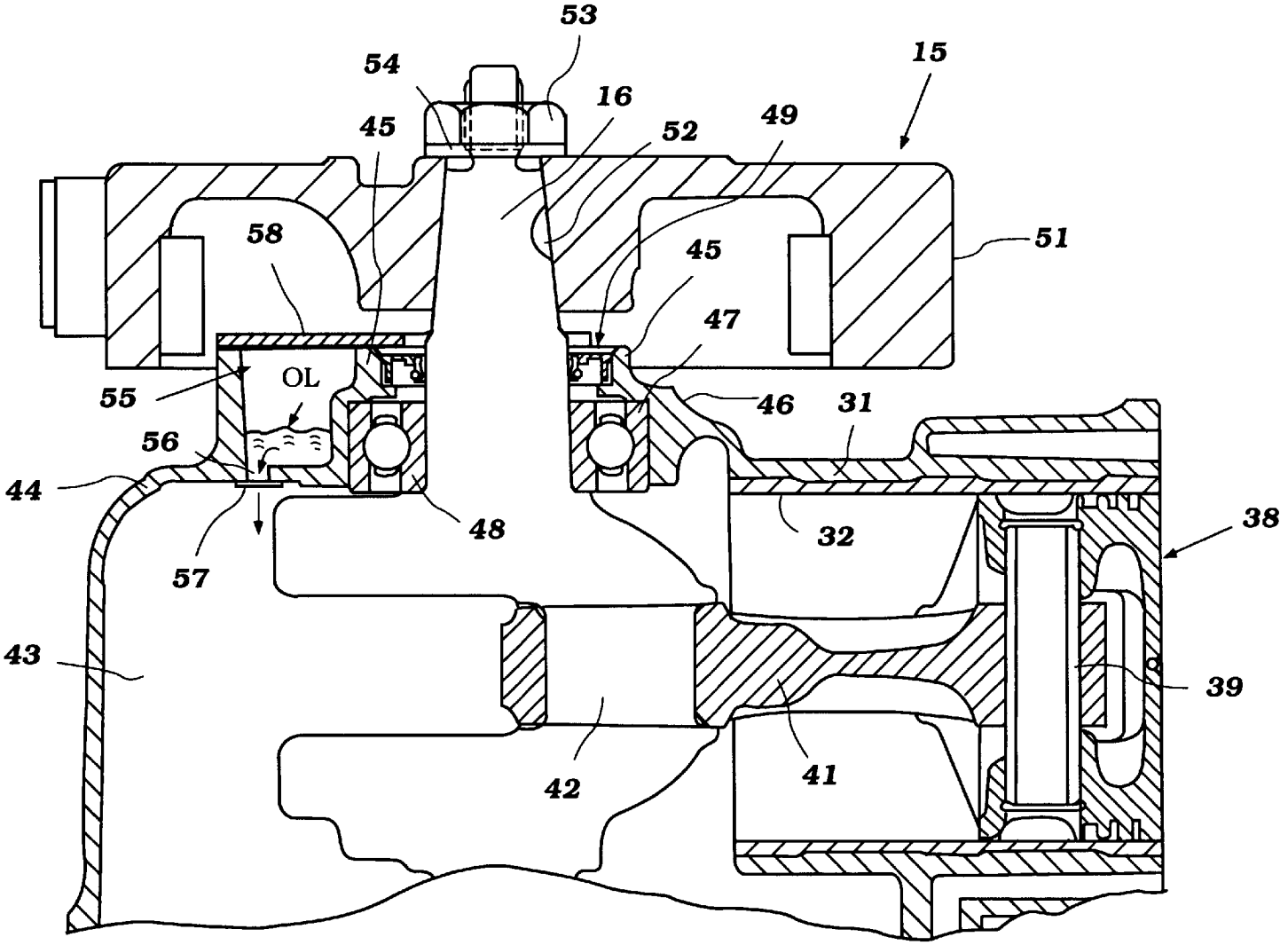
FIG. 4 is an enlarged cross-sectional view taken along the line 4—4 of FIG. 2.
Figure 5:
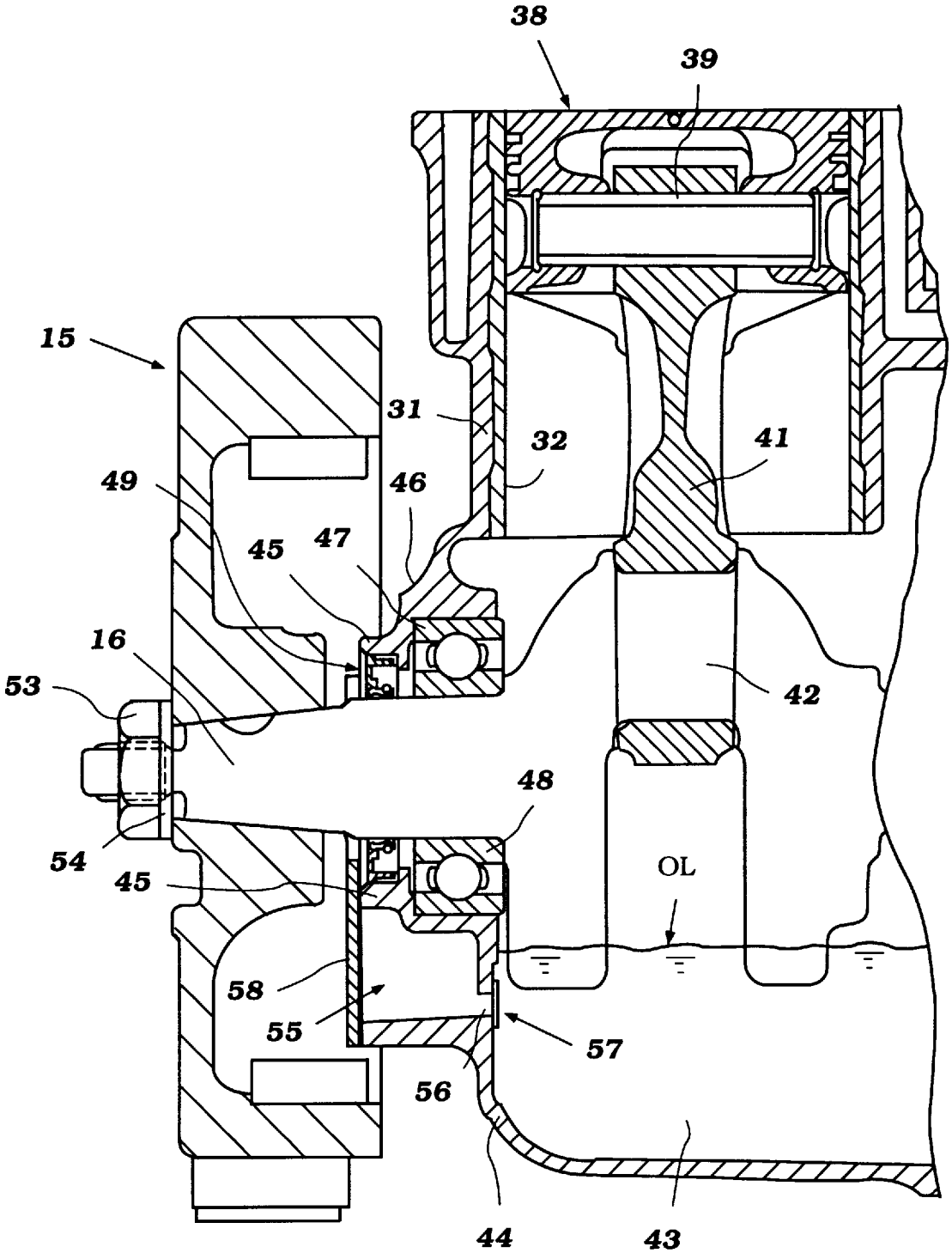
FIG. 5 is a cross-sectional view taken along the same plane as FIG. 4 but shows the arrangement when the outboard motor is tilted up to the phantom line position shown in FIG. 1.

Referring now primarily to FIGS. 3–5, it will be seen that a piston 38 reciprocates in each cylinder bore 32 and cooperates with the aforenoted cylinder head 33 to form the respective combustion chamber which is not actually shown in the figures for the aforenoted reason. The piston 38 is connected by means of a piston pin 39 to the upper or small end of a connecting rod 41. The lower end of the connecting rod 41 is journaled on a throw 42 of the crankshaft 16.

The crankshaft 16 rotates in a crankcase chamber 43 which is formed by the cylinder block 31 and a crankcase member 44 that is detachably affixed thereto. A boss 45 is formed at the upper end of the crankcase chamber 43 by an end wall member of the crankcase member cylinder block assembly, which wall member is indicated generally by the reference numeral 46. A bearing 47 is provided in this wall 46 member and has an inner race 48 that journals the upper portion of the crankshaft 16. As may be seen, the crankshaft 16 extends through this wall member 46 and beyond the boss 45.

An oil seal 49 is contained within the boss 46 for preventing oil leakage from the bearing 47 through the wall opening through which the crankshaft 16 extends.

A flywheel 51, which may include a flywheel magneto, is affixed to the upper end of the crankshaft 16 by means of a key 52, nut 53, and washer 54.

In accordance with the invention, a ventilating air chamber 55 is formed in the wall member 46. This ventilating chamber 55 communicates with the crankcase chamber 43 through a small opening 56. This opening 56 is disposed at an area where it will be disposed below the level of the oil, indicated by the line OL in FIG. 5, when the outboard motor 11 is tilted up to its out-of-water position as shown in the phantom line in FIG. 1 and in FIG. 5.

In order to preclude the flow of lubricant from the crankcase chamber 43 into the ventilating air chamber 55, a check valve 57 is provided on the inner side of the wall 46.

This check valve 57 will close when the outboard motor is tilted up and prevent oil from flowing into the ventilating air chamber 55.

Figure 2:
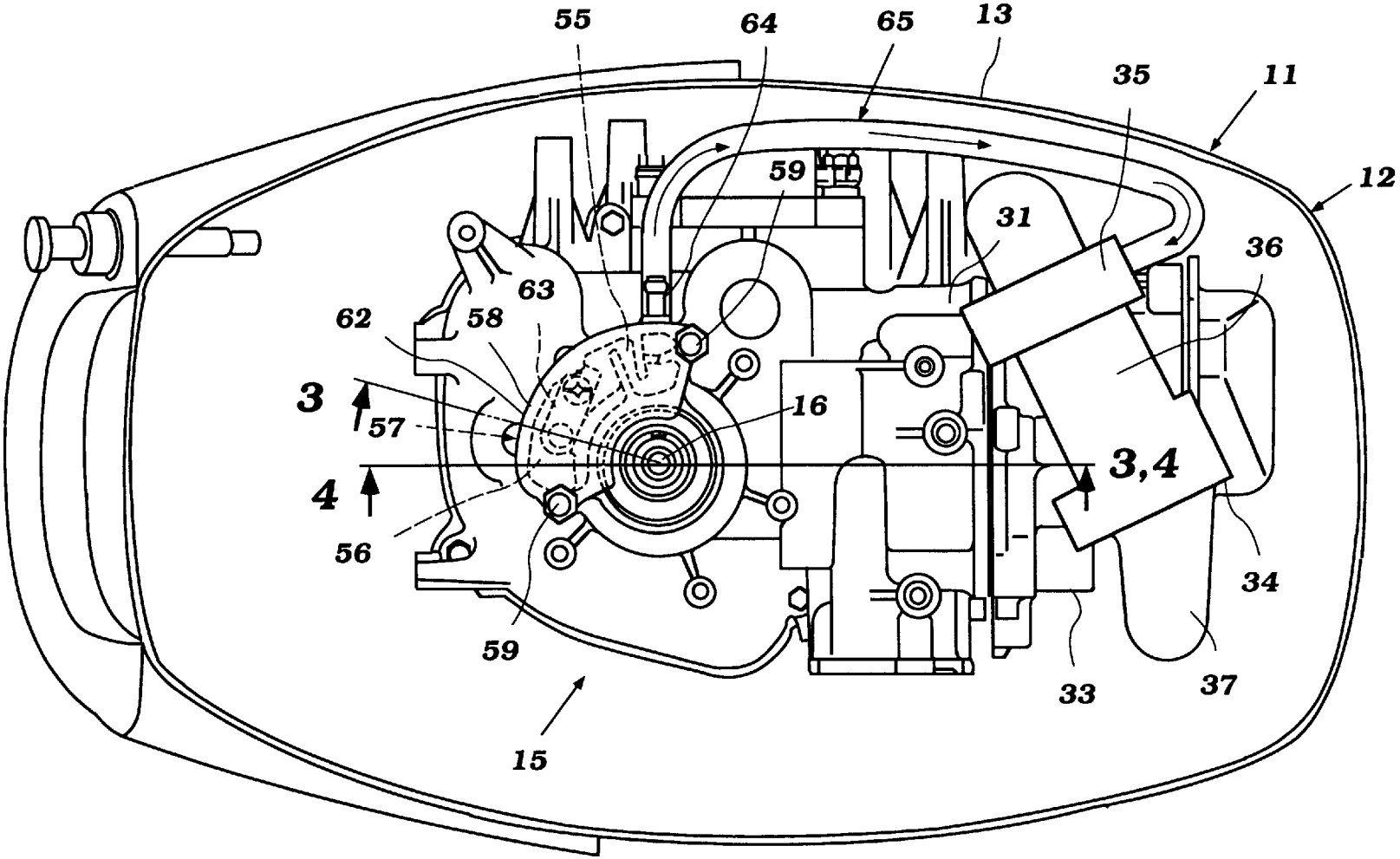
FIG. 2 is an enlarged top plan view of the powerhead of the outboard motor with a portion of the cowling removed so as to more clearly show the engine arrangement.

This ventilating air chamber 55 is closed on the outer surface of the wall 46 by a cover plate 58 that is held in place by threaded fasteners 59 (FIG. 2).

When the outboard motor is tilted back up from the position shown in FIG. 4 to the position shown in FIG. 5, the relatively light check valve 57 will open and permit the oil to drain back.

The desirability of permitting pressure relief and ventilating air flow through the crankcase chamber 43 is well known. The air ventilating chamber 55 is utilized for this purpose and provides a much simpler ventilation system than those normally employed.

As may be seen in FIG. 3, the wall member 46 is provided with a further boss portion 61 that is spaced radially from the axis of rotation of the crankshaft 16 less than the distance of the wall aperture 56. This boss portion is also disposed vertically above the aperture 56 when the outboard motor 11 is tilted up. A ventilating passage 62 is formed in this boss 61 and is positioned quite close to the bearing 47 so as to minimize the exposure to lubricant when the engine is in the horizontal position shown in phantom in FIG. 1 and in FIG. 5.

To further assist in ensuring that lubricant will not flow into the air ventilation chamber 55 through the passage 62, a relatively light check valve 63 is provided for closing the upper end of the passage 62. This light check valve 63 will open when pressure occurs in the crankcase 43 and permit the blow-by gases to escape through a system which will now be described by reference to FIG. 2. As will become apparent, when the engine is running, the reduced pressure in the intake system will assist in opening of the check valve 63.

Referring now specifically to FIG. 2, the end wall member 46 is provided with a nipple 64 to which one end of a crankcase ventilation hose 65 is connected. The other end of this hose is connected to a nipple on the air inlet silencing device 35 so that crankcase and blow-by gases may flow in the direction indicated by the arrows into the induction system. These crankcase gases will then be delivered to the combustion chamber of the engine for burning and purification before discharge to the atmosphere along with the other exhaust gases to the engine.

Thus, from the foregoing description, it should be readily apparent that the described construction provides a very effective seal for the crankshaft as well as a ventilating arrangement for ventilating the crankcase while ensuring against leakage of lubricant when the engine is tilted up to and out of the water condition. Of course, the foregoing description is that of a preferred embodiment of the invention and various changes and modifications may be made without departing from the spirit and scope of the invention, as defined by the appended claims.

I claim:

1. A crankcase seal arrangement for an internal combustion engine having a crankcase chamber in which a crankshaft rotates, said crankcase chamber being defined at one end by a wall member through which one end of said crankshaft extends, a bearing fixed in said wall member and journaling said crankshaft end, said wall defining at least in part an air chamber contiguous to said bearing, an opening in said wall member permitting communication between said crankcase chamber and said air chamber, and a check valve for controlling the flow through said opening.

2. The crankcase seal arrangement for an internal combustion engine of claim 1, wherein the check valve precludes flow from the crankcase chamber into the air chamber and permits flow from the air chamber into the crankcase chamber.

3. The crankcase seal arrangement for an internal combustion engine of claim 1, wherein the check valve permits flow from the crankcase chamber into the and precludes flow from the air chamber into the crankcase chamber.

4. The crankcase seal arrangement for an internal combustion engine of claim 1, wherein there is provided a further aperture in the wall member communicating the crankcase chamber with the air chamber.

5. The crankcase seal arrangement for an internal combustion engine of claim 4, further including a check valve for controlling the flow through the further aperture.

6. The crankcase seal arrangement for an internal combustion engine of claim 5, wherein one of the check valves permits flow from the crankcase chamber to the air chamber and the other of the check valve permits flow from the air chamber to the crankcase chamber.

7. The crankcase seal arrangement for an internal combustion engine of claim 6, wherein the apertures are spaced circumferentially from each other relative to the crankshaft axis.

8. The crankcase seal arrangement for an internal combustion engine of claim 1, further including an induction system for delivering an air charge to a combustion chamber of the engine and a passageway communicating the air chamber with the induction passage.

9. An outboard motor in combination with the crankcase seal arrangement for an internal combustion engine of claim 1, wherein the engine forms a portion of a power head of the outboard motor for driving a propulsion device for a watercraft, said outboard motor being supported for pivotal movement about a horizontal axis between a normal position wherein the crankshaft axis extends vertically and a storage position wherein the crankshaft axis extends horizontally.

10. The outboard motor of claim 9, wherein the check valve precludes flow from the crankcase chamber into the air chamber and permits flow from the air chamber into the crankcase chamber.

11. The outboard motor of claim 10, wherein the check valve permits flow from the crankcase chamber into the and precludes flow from the air chamber into the crankcase chamber.

12. The outboard motor of claim 9, wherein there is provided a further aperture in the wall member communicating the crankcase chamber with the air chamber.

13. The outboard motor of claim 12, further including a check valve for controlling the flow through the further aperture.

14. The outboard motor of claim 13, wherein one of the check valves permits flow from the crankcase chamber to the air chamber and the other of the check valve permits flow from the air chamber to the crankcase chamber.

15. The outboard motor of claim 14, wherein the apertures are spaced circumferentially from each other relative to the crankshaft axis.

16. The outboard motor of claim 13, further including an induction system for delivering an air charge to a combustion chamber of the engine and a passageway communicating the air chamber with the induction passage.

* * * * *